US005712606A

United States Patent [19]

Särkkä

[11] Patent Number: 5,712,606

[45] Date of Patent: Jan. 27, 1998

[54] DIELECTRIC RESONATOR HAVING ADJUSTMENT BODIES, FOR MAKING FAST AND FINE ADJUSTMENTS TO RESONANCE FREQUENCY

[75] Inventor: Veli-Matti Särkkä, Oulunsalo, Finland

[73] Assignee: Nokia Telecommunications Oy, Espoo, Finland

[21] Appl. No.: 646,326

[22] PCT Filed: Oct. 4, 1995

[86] PCT No.: PCT/FI95/00548

§ 371 Date: Jun. 4, 1996

§ 102(e) Date: Jun. 4, 1996

[87] PCT Pub. No.: WO96/11512

PCT Pub. Date: Apr. 18, 1996

[30] Foreign Application Priority Data

Oct. 5, 1994 [FI] Finland ..... 944664

[51] Int. Cl.[6] ..... H01P 7/10

[52] U.S. Cl. ..... 333/219.1; 333/235

[58] Field of Search ..... 333/219.1, 231, 333/232, 233, 235

[56] References Cited

U.S. PATENT DOCUMENTS 4,728,913 3/1988 Ishikawa et al. ..... 333/235

FOREIGN PATENT DOCUMENTS 0 316 813 5/1989 European Pat. Off. .
42 41 027 6/1994 Germany .
5136614 6/1993 Japan ..... 333/235
2 261 556 5/1993 United Kingdom .

*Primary Examiner*—Robert Pascal
*Assistant Examiner*—Barbara Summons
*Attorney, Agent, or Firm*—Cushman Darby & Cushman Intellectual Property Group of Pillsbury Madison & Sutro LLP

[57] ABSTRACT

A dielectric resonator including a cylindrical dielectric resonator body having a concentric cylindrical recess. A resonance frequency controller includes an adjustment mechanism and a cylindrical dielectric adjustment body which is movable by means of the adjustment mechanism in the axial direction inside the recess of the resonator body for adjusting the resonance frequency. The frequency controller further includes a dielectric fine adjustment body attached to the adjustment mechanism and arranged inside the adjustment body so that the projection of the fine adjustment body at the end of the adjustment body within the recess in the resonator body can be adjusted by a movement of the adjustment mechanism. Thus, the frequency controller has two slopes of adjustment, whereby the adjustment is fast owing to the movement of both adjustment bodies and also extremely accurate owing to the fine adjustment function, which is achieved when the smaller adjustment body is moved alone.

6 Claims, 2 Drawing Sheets

DIELECTRIC RESONATOR HAVING ADJUSTMENT BODIES, FOR MAKING FAST AND FINE ADJUSTMENTS TO RESONANCE FREQUENCY

This application claims benefit of international application PCT/FI95/00548, filed Oct. 4, 1995.

BACKGROUND OF THE INVENTION

The invention relates to a dielectric resonator comprising a cylindrical dielectric resonator body comprising a concentric cylindrical recess; a frequency controller comprising an adjustment screw and a second cylindrical dielectric adjustment body, which is movable by means of the adjustment screw in the axial direction within the recess in the resonator body for adjusting the resonance frequency; and an electrically conductive casing.

Recently, so-called dielectric resonators have become more and more interesting in high frequency and microwave range structures, as they provide the following advantages over conventional resonator structures: smaller circuit sizes, higher degree of integration, improved performance and lower manufacturing costs. Any object which has a simple geometric shape, and the material of which exhibits low dielectric losses and a high relative dielectric constant may function as a dielectric resonator having a high Q value. For reasons related to manufacturing technique, a dielectric resonator is usually of a cylindrical shape, such as a cylindrical disc.

The structure and operation of dielectric resonators are disclosed, e.g. in the following articles:

[1] "Ceramic Resonators for Highly Stabile Oscillators", Gundolf Kuchler, Siemens Components XXIV (1989) No. 5, p. 180–183.

[2] "Microwave Dielectric Resonators", S. Jerry Fiedziuszko, Microwave Journal, September 1986, p. 189–189.

[3] "Cylindrical Dielectric Resonators and Their Applications in TEM Line Microwave Circuits", Marian W. Pospieszalski, IEEE Transactions on Microwave Theory and Techniques, VOL. MTT-27, NO. 3, March 1979, p. 233–238.

The resonance frequency of a dielectric resonator is primarily determined by the dimensions of the resonator body. Another factor that has an effect on the resonance frequency is the environment of the resonator. By bringing a metallic or some other conductive surface to the vicinity of the resonator, it is possible to intentionally affect the electric or magnetic field of the resonator, and thus the resonance frequency. In a typical method for adjusting the resonance frequency of the resonator, the distance of a conductive metallic surface from the planar surface of the resonator is adjusted. The resonance frequency varies as a non-linear function of the adjustment distance. Due to this non-linearity and the steep slope of adjustment, accurate adjustment of the resonance frequency is difficult and demands great precision. Furthermore, an unloaded Q value varies as a function of the distance of the conductive plane.

It is possible to keep the Q value constant and achieve more linear frequency adjustment in a wider range by bringing another dielectric body to the vicinity of the resonator body instead of a conductive adjustment plane. In this case, too, the adjustment curve is still steep. One prior art dielectric filter design of this kind is shown in FIG. 1, in which a resonator comprises inductive coupling loops 5 (input and output), a dielectric resonator body 3 in a metal casing 4 and supported by a dielectric or isolating leg 6, and comprising a concentric cylindrical recess 7. The resonator further comprises a frequency adjustment mechanism comprising an adjustment screw 1 and a dielectric cylindrical adjustment body 2, which is movable by means of the adjustment screw 1 in the axial direction inside the recess 7 of the resonator body 3 for adjusting the resonance frequency. The resonance frequency of the resonator depends on the distance L between the bottom of the recess 7 of the resonator body 3 and the bottom surface of the adjustment body 2 in accordance with a graph in FIG. 2.

As appears from FIG. 2, frequency adjustment is based on a highly accurate mechanical movement, the slope of adjustment k also being steep. When the resonance frequency becomes higher, e.g. to the range 1500–2000 MHz or higher, the dimensions of the basic elements of the dielectric filter, such as those of the resonator body 3 or the adjustment mechanism 1, 2 are reduced. As a result, adjusting the resonance frequency of a dielectric resonator with prior art solutions sets very high demands on the frequency adjustment mechanism, which, in turn, increases the material and production costs. In addition, as the mechanical movements of the frequency adjustment device must be made very small, adjustment will be slower.

SUMMARY OF THE INVENTION

The object of the invention is a dielectric resonator providing a higher adjustment accuracy and speed.

This is achieved with a dielectric resonator, which is characterized in accordance with the invention in that the second cylindrical adjustment body comprises a dielectric fine adjustment resonator body, which is connected to the adjustment screw and arranged inside the second resonator, so that a projection of the fine adjustment resonator body at the end of the resonator body within the recess in the first resonator body can be adjusted by a movement of the adjustment screw.

The frequency controller of the resonator of the invention consists of a pair of joined dielectric adjustment bodies, which are mechanically engaged with each other so that their movement with respect to each other and the resonator body provides two adjustment phases during one adjusting movement. At the beginning of the adjusting movement, the smaller adjustment body, i.e. the so-called fine adjustment body moves a predetermined distance with respect to the larger adjustment body and the resonator body, while the larger adjustment body remains stationary, due to a specific friction surface. Once the smaller adjustment body has moved the predetermined distance, the larger adjustment body also starts to move in accordance with the adjusting movement. Thus, a dielectric resonator is achieved the frequency controller of which has two slopes of adjustment, whereby the adjustment is fast owing to the movement of both adjustment bodies, and also extremely accurate owing to the fine adjustment function, which is achieved when the smaller adjustment body is moved alone. By means of the invention, the adjustment accuracy may be improved as much as tenfold, so that the demands on the accuracy of the adjustment mechanics do not have to be made stricter when the frequency is increased, or they may be even moderated for the presently used frequencies.

BRIEF DESCRIPTION OF THE DRAWINGS

In the following, the invention will be disclosed in greater detail by way of example with reference to the attached drawings, in which.

DETAILED DESCRIPTION

The structure, the operation and the ceramic manufacturing materials of dielectric resonators are disclosed, e.g. in the above-mentioned articles [1], [2], and [3], which are incorporated herein by reference. In the following description, only the parts in the structure of the dielectric resonator which are essential to the invention will be disclosed.

The term dielectric resonator body, as used herein, generally refers to any object which has a suitable geometric shape, and the manufacturing material of which exhibits low dielectric losses and a high relative dielectric constant. For reasons related to manufacturing technique, a dielectric resonator usually has a cylindrical shape, such as a cylindrical disc. The most commonly used material is ceramic material.

Figure 1:
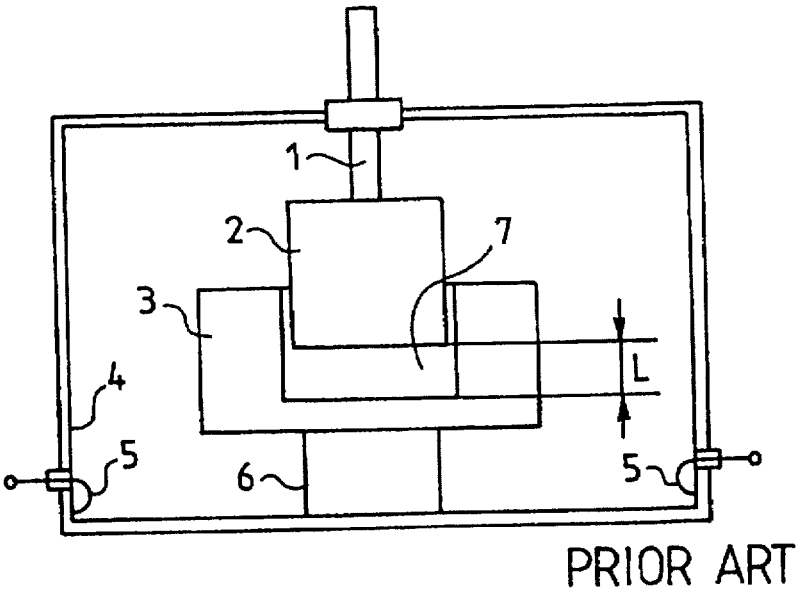
FIG. 1 shows a cross-sectional side view of a prior art dielectric resonator.
Figure 2:
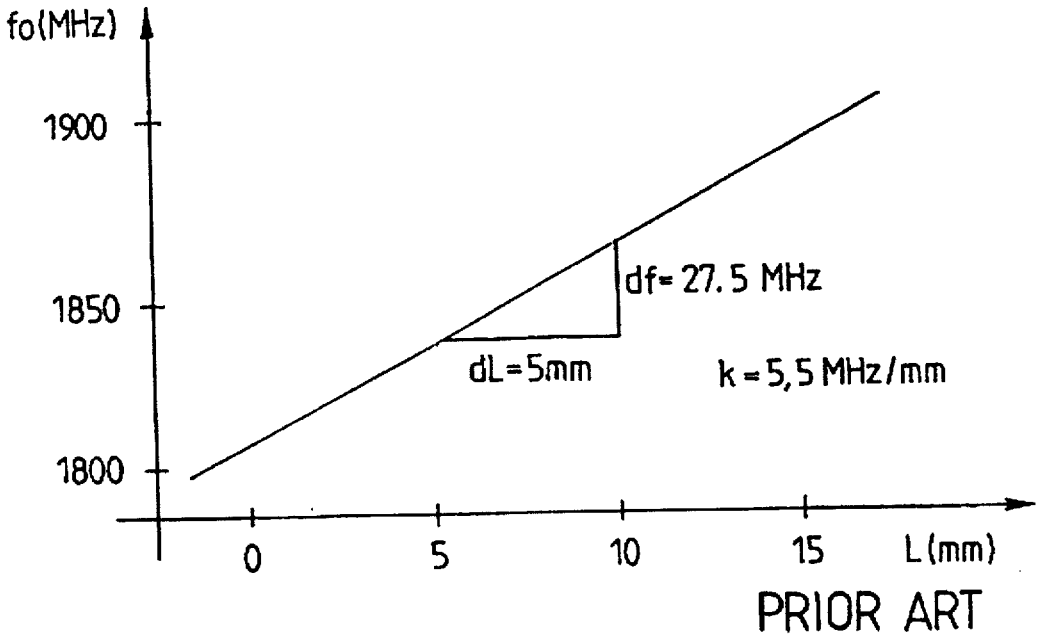
FIG. 2 shows a graph illustrating the resonance frequency of the resonator shown in FIG. 1 as a function of distance L.
Figure 3:
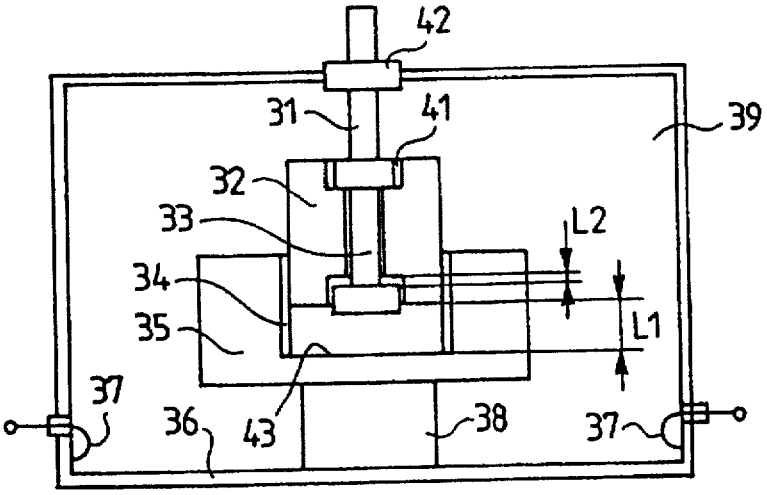
FIG. 3 shows a cross-sectional side view of a dielectric resonator of the invention.

FIG. 3 shows a dielectric resonator of the invention, comprising a dielectric, preferably cylindrical resonator body 35 disposed inside the cavity 39 defined within a casing 36 made of an electrically conductive material, such as metal, the resonator body being preferably ceramic and installed at a fixed distance from the bottom of the casing 36, on a supporting leg 38 made of a suitable dielectric or isolating material. The casing 36 is coupled to the ground potential.

The electromagnetic fields of a dielectric resonator extend beyond the resonator body, so it may easily be coupled electromagnetically to the rest of the resonator circuit in a variety of ways, depending on the application, e.g. with a microstrip conductor in the vicinity of the resonator, a bent coaxial cable, a normal straight wire, etc. FIG. 3 shows by way of example coupling to the resonator by inductive coupling loops 37, which provide the input and the output of the resonator.

The resonator frequency of a dielectric resonator is primarily determined by the dimensions of the dielectric resonator body 35. Another factor that has an effect on the resonance frequency is the environment of the dielectric resonator body. By introducing a metallic or some other conductive surface to the vicinity of the resonator body, it is possible to intentionally affect the electric or magnetic field of the resonator, and thus the resonance frequency. A dielectric adjusting element used in the adjustment of the resonator of the invention consists of a pair of joined dielectric adjustment bodies 32 and 33, which are mechanically engaged with each other, so that their movement with respect to each other and with respect to the ceramic object provides two adjustment phases during one adjusting movement. At the beginning of the adjusting movement, the smaller adjustment plane (or plate or body) 33, or the so-called fine adjustment body, moves a predetermined distance L2 with respect to the larger adjustment plane (or plate or body) 32 and the dielectric resonator body 35, while the larger adjustment body 32 remains stationary due to a specific friction surface. Once the smaller adjustment plane has moved said distance L2, the larger adjustment body 32 also starts to move in accordance with the adjusting movement.

Described in more detail, the resonance frequency controller comprises a dielectric (preferably ceramic) cylindrical dielectric adjustment body 33, which is movable by means of an adjustment mechanism in the axial direction inside a cylindrical recess 43 situated on the top surface of a resonator body 35 for adjusting the resonance frequency. The adjustment mechanism consists of an adjustment screw 31 and a bushing 42, or another suitable adjustment mechanism. The resonance frequency controller further comprises a dielectric fine adjustment body 33 connected to the adjustment mechanism 31 and arranged inside adjustment body 32, so that the projection of the fine adjustment body 33 may be adjusted by a movement of the adjustment mechanism 31 at that end of adjustment body 33 which is located inside the recess 43 of the resonator body 35. The contact surface between the recess 43 of the resonator body 35 and adjustment body 32 is a friction surface 34 which keeps adjustment body 32 stationary inside the resonator body 35 when the fine adjustment body is moved by means of the adjustment mechanism.

Figure 4:
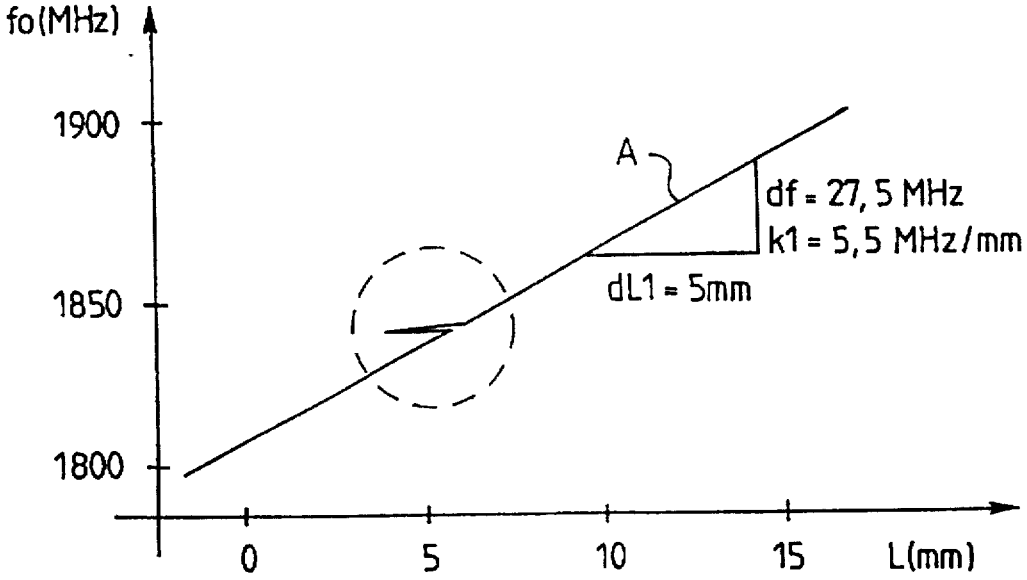
FIG. 4 shows a graph illustrating the resonance frequency of the resonator shown in FIG. 3 as a function of distance L.
Figure 4A:
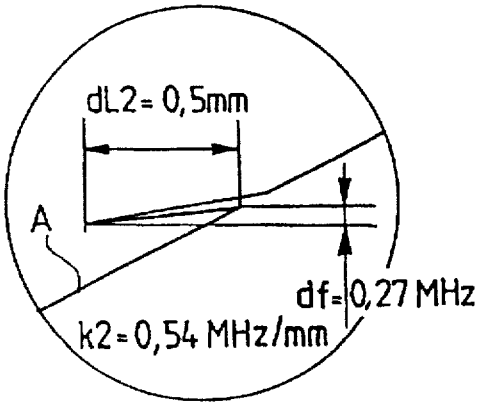
FIG. 4*a* shows an enlarged detail of the graph in FIG. 4.

In the embodiment shown in FIG. 3, a cylindrical adjustment body 32 comprises a vertically I-shaped centre hole 41, which extends in the axial direction through adjustment body 32 from the top surface to the bottom surface. The fine adjustment body 33 is vertically I-shaped, and its arm (narrow middle part) is longer than the narrower middle part of the centre hole of adjustment body 32, so that the fine adjustment body 33 in the centre hole 41 is allowed a predetermined axial movement range L2 inside adjustment body 32 before the upper or the lower end claw (broader end part) of the I-shaped fine adjustment body 33 touches the bottom of the upper or the lower end opening (broader opening of the centre hole) of the I-shaped centre hole 41 of adjustment body 32, causing a grip which transfers the movement of the adjustment mechanism 31 via the fine adjustment body 33 so that it also moves adjustment body 32 axially, which compensates the friction of the friction surface 34. The allowed movement range of adjustment body 32 is L1. Thus, a dielectric resonator is achieved the frequency controller of which has two slopes of adjustment, whereby the adjustment is fast when both adjustment bodies 32 and 33 are moved, and slower, but extremely accurate when the smaller fine adjustment body 33 is moved alone. The graph in FIG. 4 shows the resonance frequency fo of the resonator of the invention as a function of the movement L of the adjustment plane. In FIG. 4, curve A describes the adjustment when both adjustment bodies 32 and 33 are moved, the slope of adjustment k1 being, e.g. 5.5 MHz/mm. At the circle marked with a broken line, fine adjustment is performed solely with a movement of adjustment body 33, which is achieved by changing the rotating direction of the adjustment screw 31. An enlargement of a part of curve A corresponding to the fine adjustment situation is shown in FIG. 4*a*, from which appears that slope of adjustment k2 of fine adjustment is remarkably lower than k1, e.g. 0.54 MHz/mm. The relation k2/k1 of the slopes of adjustment is directly proportional to the relation of the areas of adjustment bodies 32 and 33. In other words, it is possible to select the appropriate slopes of adjustment by selecting appropriate areas.

The figures and the explanation associated therewith are only intended to illustrate the above invention. The resonator of the invention may vary in its details within the scope of the attached claims.

I claim:

1. A dielectric resonator comprising:

a cylindrical dielectric resonator body having a coaxial cylindrical recess;

a frequency controller comprising an adjustment mechanism and a cylindrical dielectric adjustment body, which is movable by means of the adjustment mechanism axially of said resonator body within said recess in said resonator body, for adjusting the resonance frequency provided by said dielectric resonator;

an electrically conductive casing, for said resonator body and said cylindrical dielectric adjustment body;

a dielectric fine adjustment body connected to said adjustment mechanism and arranged inside said cylindrical dielectric adjustment body, so that extent of projection of the dielectric fine adjustment body at an end of said cylindrical dielectric adjustment body within said recess in said resonator body can be adjusted within a predetermined range by movement of said adjustment mechanism; and said cylindrical dielectric adjustment body being arranged to remain stationary inside said resonator body during adjustment of said extent of projection of said dielectric fine adjustment body, so that during a common movement of said cylindrical dielectric adjustment body and said dielectric fine adjustment body, frequency adjustment has a first slope of adjustment, and upon said dielectric fine adjustment body being moved alone by said adjustment mechanism, frequency adjustment has a second slope of adjustment which is remarkably lower than said first slope of adjustment.

2. A dielectric resonator as claimed in claim 1, wherein:

said dielectric fine adjustment body and said cylindrical dielectric adjustment body are provided with grip surfaces, which allow a predetermined extent of axial movement of said dielectric fine adjustment body relative to said cylindrical dielectric adjustment body before said dielectric fine adjustment body grips said cylindrical dielectric adjustment body for transferring movement of said adjustment mechanism into axial movement of said cylindrical dielectric adjustment body.

3. A dielectric resonator as claimed in claim 1 wherein:

said cylindrical dielectric adjustment body comprises a vertically I-shaped axial bore, and said dielectric fine adjustment body is I-shaped in longitudinal cross-sectional profile so as to have two axially opposite end claws and is axially longer than said axial bore, so that a specific amount of axial movement of said dielectric fine adjustment body inside said cylindrical dielectric adjustment body is allowed before one end claw of said dielectric fine adjustment body engages a shoulder at one end said I-shaped axial bore of said cylindrical dielectric adjustment body causing a grip, which transfers movement of said adjustment mechanism from said dielectric fine adjustment body to said cylindrical dielectric adjustment body so that said movement of said adjustment mechanism also causes axial movement of said cylindrical dielectric adjustment body.

4. A dielectric resonator as claimed in claim 1, wherein:

said adjustment mechanism comprises an adjustment screw which is attached to said casing.

5. A dielectric resonator as claimed in claim 1, comprising:

contact surface means which keep said cylindrical dielectric adjustment body stationary inside said resonator body when said dielectric fine adjustment body is axially moved by said adjustment mechanism within said predetermined range.

6. A dielectric resonator as claimed in claim 5, wherein:

said contact surface means are provided between said recess of said resonator body and said cylindrical dielectric adjustment body as friction surfaces, which keep said cylindrical dielectric adjustment body stationary inside said resonator body when said dielectric fine adjustment body is moved by said adjustment mechanism within said predetermined range.

* * * * *